US006518002B1

(12) United States Patent
Foster

(10) Patent No.: US 6,518,002 B1
(45) Date of Patent: Feb. 11, 2003

(54) PHOTOGRAPHIC BLEACHING SOLUTION CONTAINING ORGANIC PHOSPHORUS ACID ANTI-RUST AGENT AND METHOD OF USE

(75) Inventor: David G. Foster, West Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/795,885

(22) Filed: Feb. 6, 1997

(51) Int. Cl.[7] ..... G03C 7/42
(52) U.S. Cl. ..... 430/461
(58) Field of Search ..... 430/461

(56) References Cited

U.S. PATENT DOCUMENTS 3,928,040 A * 12/1975 Shimamura et al. ..... 430/460
4,294,914 A 10/1981 Fyson ..... 430/418
4,301,236 A * 11/1981 Idota et al. ..... 430/461
4,444,873 A * 4/1984 Ishikawa et al. ..... 430/461
5,061,608 A 10/1991 Foster et al. ..... 430/461
5,093,228 A * 3/1992 Nakamura ..... 430/460
5,334,491 A 8/1994 Foster et al. ..... 430/393
5,352,568 A * 10/1994 Kuse et al. ..... 430/461
5,508,150 A * 4/1996 Craver et al. ..... 430/463

* cited by examiner

*Primary Examiner*—Hoa Van Le
(74) *Attorney, Agent, or Firm*—J. Lanny Tucker

(57) ABSTRACT

An effective, biodegradable photographic bleaching solution comprises, as a bleaching agent, a ferric alkyliminodiacetic acid complex, and a particular organic phosphonic or phosphinic acid as an anti-rust agent. This anti-rust agent reduces or eliminates the formation of iron hydroxide in the processing solutions following the bleaching step, and further improves bleaching effectiveness.

15 Claims, 1 Drawing Sheet

PHOTOGRAPHIC BLEACHING SOLUTION CONTAINING ORGANIC PHOSPHORUS ACID ANTI-RUST AGENT AND METHOD OF USE

FIELD OF THE INVENTION

This invention relates to a photographic bleaching solution that contains a ferric complex of an alkyliminodiacetic acid as a bleaching agent, and an organic phosphorus acid as an anti-rust agent. This invention also relates to a method of using this solution in photographic processing.

BACKGROUND OF THE INVENTION

The basic image-forming process of color photography comprises the exposure of a silver halide photographic recording material, such as a film, to light, and the chemical processing of the material to reveal a useful image. The chemical processing involves two fundamental steps. The first is a treatment of the exposed silver halide with a color developing agent wherein some or all of the silver ion is reduced to metallic silver.

The second is the removal of the silver metal by the individual or combined steps of bleaching and fixing so that only dye remains in the processed material. During bleaching, the developed silver is oxidized to a silver salt by a suitable bleaching agent. The oxidized silver is then dissolved and removed from the element in a fixing step. Most commonly, a wash bath is used between the bleaching and fixing steps.

The most common bleaching agents are complexes of ferric ion and various organic ligands, of which there are dozens of possibilities, all with varying bleaching activities and biodegradability. Common organic ligands for this purpose include ethylenediaminetetraacetic acid (EDTA), propylenediaminetetraacetic acid (PDTA) and nitrilotriacetic acid (NTA).

U.S. Pat. No. 4,294,505 (Fyson) describes bleaching and bleach-fixing compositions and method using a ferric complex of one of several alkyliminodiacetic acids, which are known to be more biodegradable than other common organic ligands such as ethylenediaminetetraacetic acid (EDTA). Other bleaching agents using similar organic ligands are described in U.S. Pat. No. 5,061,608 (Foster et al) in which the bleaching agent is advantageously combined with specific aliphatic carboxylic acids to reduce dye stains. U.S. Pat. No. 5,334,491 (Foster et al) also describes similar bleaching agents in combination with specific levels of bromide ion.

DE 4,226,372 (Tappe et al) describe bleaching solutions containing excess β-alaninediacetic acid (ADA) and a hydroxycarboxylic acid, such as citric acid or tartaric acid, to reduce the precipitation of iron hydroxide (that is, ferrous hydroxide or "rust") in the wash bath following bleaching.

It has been observed that it is unpredictable as to what materials will perform this function with any given bleaching agent. In processes utilizing methyliminodiacetic acid (MIDA) as the bleaching agent, iron-MIDA dissociation may occur in the wash bath. This rust formation must be controlled by preventing the dissociation of MIDA from ferric ion.

Thus, there is a need for specific anti-rust agents that will be effective with ferric alkyliminodiacetic acid bleaching agents without hindering bleaching efficiency.

SUMMARY OF THE INVENTION

The problems noted above have been overcome with a photographic bleaching solution comprising:

a) as a bleaching agent, a ferric ion complex of an alkyliminodiacetic acid or salt thereof, the alkyl group having from 1 to 6 carbon atoms, and b) an organic phosphonic acid or phosphinic acid represented by one of the structures (I) or (II) below, provided that the bleaching solution contains at least about 0.005 mol/l of ferric ion, and further provided that the anti-rust agent is present in an amount of at least about 0.008 mol/l, wherein structures (I) and (II) are:

$$R_1N\ (CH_2PO_nM_2)_2 \text{ and} \quad (I)$$

$$R_2R_3C\ (PO_nM_2)_2 \quad (II)$$

wherein n is 2 or 3, $R_1$ is hydrogen, alkyl of 1 to 12 carbon atoms, alkylaminoalkyl, alkoxyalkyl of 2 to 12 carbon atoms, cycloalkyl of 5 to 10 carbon atoms, aryl of 6 to 10 carbon atoms in the aromatic ring, or a 5- to 10-membered heterocyclic group having one or more nitrogen, oxygen or sulfur atoms in the heteroring, $R_2$ is hydrogen, alkyl of 1 to 12 carbon atoms, aryl of 6 to 10 carbon atoms, cycloalkyl of 5 to 10 carbon atoms in the ring, a 5- to 10-membered heterocyclic group having one or more nitrogen, oxygen or sulfur atoms in the ring, $—PO_nM_2$ or $—CH_2R_4PO_nM_2$, $R_3$ and $R_4$ are independently hydrogen, hydroxy, alkyl of 1 to 12 carbon atoms or $—PO_nM_2$, and M is hydrogen or a water-soluble monovalent cation.

This invention also provides a method of processing a color silver halide photographic element comprising:

bleaching an imagewise exposed and developed color silver halide photographic element with the photographic bleaching solution described above.

The bleaching solution of this invention exhibits a much reduced tendency for rust formation in the processing tanks (that is, wash baths) following the bleaching tank without a loss in bleaching efficiency. Moreover, the bleaching solution is highly biodegradable and therefore avoids environmental concerns. Biogrowth is hindered in the bleach tank as well in the following processing tanks.

DETAILED DESCRIPTION OF THE INVENTION

Figure 1:
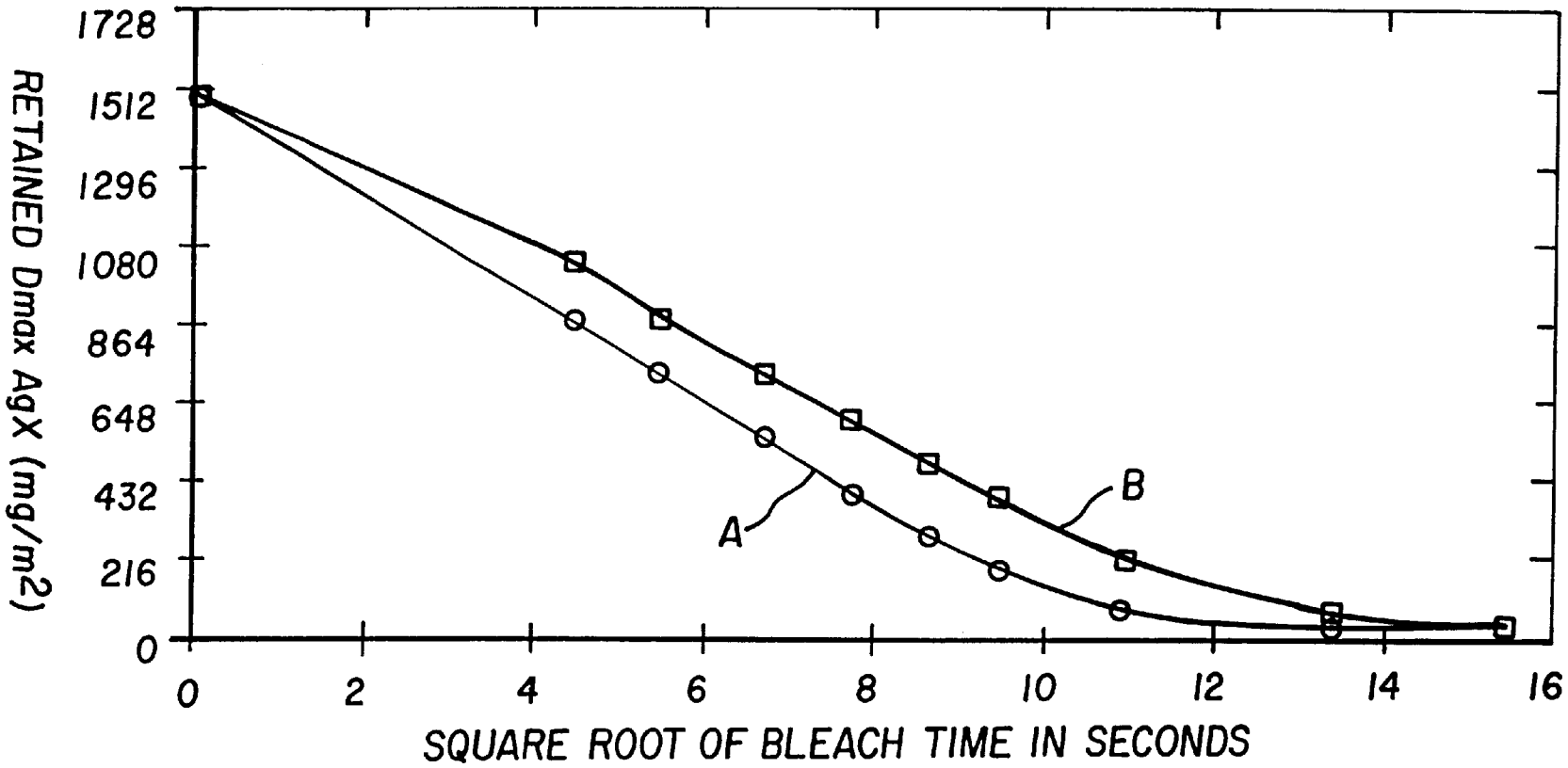
FIG. 1 is a graphical representation of data obtained in Example 3 below.

The bleaching solution of this invention comprises, as the bleaching agent, one or more ferric complexes of alkyliminodiacetic acids (or salts thereof). Such alkyliminodiacetic acids have a substituted or unsubstituted alkyl group having 1 to 6 carbon atoms (such as methyl, ethyl, n-propyl, isopropyl and t-butyl). Particularly useful alkyliminodiacetic acids are methyliminodiacetic acid (MIDA) and ethyliminodiacetic acid (EIDA). These ligands can be used in the free acid form or as a sodium, potassium or ammonium salt.

It is not necessary that the iron and the alkyliminodiacetic acid ligand be present in the bleaching solution in stoichiometric proportions. It is preferred that the molar ratio of the ligand to ferric iron be from about 1:1 to about 5:1. In a more preferred embodiment, the ratio is about 2 to about 3 moles of each complexing ligand per mole of ferric ion. A ratio of about 2.6:1 is most preferred.

Generally speaking, the iron is present in an amount of at least about 0.001 mol/l, and preferably from about 0.005 to about 0.5 mol/l. Lower levels of about 2 g/l are commonly used to bleach color paper. Levels of from about 10 to about 25 g/l are commonly used when rapid bleaching action is desired. Levels of about 13 g/l are commonly used to bleach color reversal materials.

In preferred embodiments, a rehalogenating agent, such as chloride or bromide ions, is present in the composition. The rehalogenating agent can be present in any effective amount, with useful amounts typically being at least about 0.1 mol/l, and preferably at least about 0.2 mol/l. Bromide ions are preferred, especially when the emulsions being processed are predominantly silver bromide. Chloride or bromide ions can be used in the form of potassium, sodium or ammonium salts.

The bleaching solution can be a bleach-fixing solution and can thus contain one or more silver ion solvents (or fixing agents) including but not limited to, thioethers, thiosulfates and thiocyanates, in conventional amounts.

The bleaching solution can also include other addenda that may be useful in bleaching solutions, such as buffers, metal sequestering agents, anti-scumming agents, antioxidants and anti-foam agents.

Useful buffers include acetic acid, propionic acid, succinic acid, tartaric acid, and other water-soluble aliphatic carboxylic acids known in the art. Acetic acid is preferred. Other buffers, such as borates and carbonates can be used if desired.

The bleaching solutions of this invention are aqueous acidic solutions preferably having a pH of from about 2 to about 5, but a different pH can be used if desired. A preferred pH is in the range of from about 2.5 to about 4.5.

An essential component of this invention is one or more anti-rust agents in an amount of at least about 0.008 mol/l, and preferably from about 0.01 to about 0.1, and more preferably from about 0.01 to about 0.08 mol/l. An optimum amount can be readily determined for a given anti-rust agent with routine experimentation.

These anti-rust agents are organic phosphonic or phosphinic acids or salts thereof, represented by the following structures I and II: Generally such compounds are represented by the structure (I):

$$R^1N(CH_2PO_nM_2)_2$$

or (II):

$$R^2R^3C(PO_nM_2)_2$$

wherein n is 2 or 3, and preferably 3, $R^1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, o-octamidobenzyl or β-phenethyl), a substituted or unsubstituted alkylaminoalkyl group (wherein the alkyl portion of the group is an defined above, such as methylaminomethyl or ethylaminoethyl), a substituted or unsubstituted alkoxyalkyl group of 1 to 12 carbon atoms (such as methoxymethyl, methoxyethyl, propoxyethyl, benzyloxy, methoxymethylenemethoxymethyl, or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, p-methoxyphenyl or 4-hydroxyphenyl), or a substituted or unsubstituted 5- to 10-membered heterocyclic group having one or more nitrogen, oxygen or sulfur atoms in the ring besides carbon atoms [such as pyridyl, primidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R^2$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_nM_2$ or $—CHR^4PO_nM_2$.

$R^3$ is hydrogen, hydroxyl, a substituted or unsubstituted alkyl group of 1 to 12 carbon atoms (defined above) or $—PO_nM_2$.

$R^4$ is hydrogen, hydroxyl, a substituted or unsubstituted alkyl group of 1 to 12 carbon atoms (as defined above) or $—PO_nM_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_nM_2$, $—CH_2PO_nM_2$ or $—N(CH_2PO_nM_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4). Representative useful compounds are 1-hydroxyethylidene-1, 1-diphosphonic acid, diethylenetriaminepentaphosphonic acid, ethylenediamine-N,N,N',N'-tetramethylenephosphonic acid, nitrilo-N,N,N-trimethylenephosphonic acid (or aminotrimethylenephosphonic acid), 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N, N-bis(methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridinylmethylamine-N,N-dimethylenephosphonic acid, 1-hydroxyethane-1,1-diphosphonic acid, diethylenetriamine-N,N,N',N",N"-penta (methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, or salts thereof.

Particularly useful are 1-hydroxyethylidene-1,1-diphosphonic acid, nitrilo-N,N,N-trimethylenephosphonic acid (or aminotrimethylenephosphonic acid), or salts thereof. The second compound is most useful.

The bleaching solution of this invention is useful in the processing of color photographic elements, including photographic color negative and reversal films, motion picture films, and photographic color papers, with or without separate fixing steps. Useful color negative-positive processes include the steps of color development, bleaching, fixing and stabilizing or washing. The steps of a color reversal process are also known. Color papers generally utilize a bleach-fixing step, but separate bleaching and fixing are also possible. This invention is particularly useful for processing color negative photographic films.

Bleaching according to this invention can be carried out in less than 6 minutes, but even shorter times are possible under certain conditions. For color films, the time may be less than 4 minutes, and for color papers, the time be less than 90 seconds. Bleaching temperatures are generally for from about 20 to about 40° C.

The bleaching solutions of this invention can be used as working tank solutions or replenishers, and can be in diluted or concentrated form for a regenerator and/or replenisher.

Bleaching solutions of this invention can be replenished using any suitable rate for a given photographic element and processing equipment and conditions, however, generally the replenishment rate is less than about 1000 ml/m$^2$. Replenishment can be accomplished directly into the processing tank, or a portion of overflow can be mixed with a regenerator to provide a suitable regenerated replenisher. The regenerator concentrate itself can be delivered directly to the processing tank.

The details of such processes including color developing solutions, fixing solutions, stabilizing solutions, conditioning solutions, first developer solutions (for reversal processes), and the color photographic elements processed therein, including emulsions, supports and other details thereof, are well known from hundreds of publications, some of which are listed in *Research Disclosure*, publication 36544, pages 501–541, September, 1994, incorporated herein by reference. *Research Disclosure* is a publication of Kenneth Mason Publications Ltd., Dudley House, 12 North Street, Emsworth, Hampshire PO10 7DQ England. Preferred color photographic materials are color negative photographic films.

It is generally convenient for the ferric complex to be formed in situ in the bleaching solution by reaction of a ferric salt, such as ferric sulfate or ferric nitrate, with the aminopolycarboxylic acid ligands described herein.

While washing is not required, such as in mini-lab processing, in a preferred embodiment, a wash step is included in the processing method of this invention immediately after the bleaching step and before the first fixing step. Washing can be carried out using water or other conventional washing solutions. When washing is used, it is particularly desired that the washing rate in this step be up to about 54,000 ml/m$^2$ of color photographic material processed. A preferred range of washing rates is from about 10,000 to about 35,000 ml/m$^2$, and more preferably, from about 5,000 to about 30,000 ml/m$^2$.

The following examples are provided to illustrate the present invention, but the invention is not to be interpreted as so limited. Unless otherwise indicated, percentages are by weight.

EXAMPLE 1

Preferred Bleaching Solution

A biodegradable bleachable solution was formulated with the following components and amounts:

| | |
|---|---|
| Potassium methyliminodiacetic acid | 70 g/l |
| Potassium bromide | 30 g/l |
| Ferric nitrate (in 100 ml water) | 48.3 g/l |
| Glacial acetic acid | 50 ml/l |
| DEQUEST 2000 (50% solution)* | 9 ml/l |
| Water | up to 1 liter |
| pH | adjusted to 4.0 |

*DEQUEST 2000 contains aminotrimethylene phosphonic acid that is commercially available from Monsanto Chemical Co.

The molar ratio of potassium-MIDA to ferric ion in this solution is 2.6:1, and ferric ion was present at 6.67 g/l.

DEQUEST 2000 contains aminotrimethylene phosphonic acid that is commercially available from Monsanto Chemical Co.

EXAMPLE 2

Alternative Bleaching Solutions

Additional bleaching solutions were prepared having the same basic formulation as described in Example 1 except that various compounds were tested as anti-rust agents. Thus, several bleaching solutions outside the invention having too little of the phosphorus anti-rust agents, were prepared and used. Other Controls contained other compounds that failed to prevent rust formation. TABLE I below shows the various bleaching solutions.

Anti-rust agents A, B and C are compounds useful in the practice of this invention. Anti-rust agent A was aminotrimethylene phosphonic acid (in DEQUEST 2000), anti-rust agent B was aminotrimethylene phosphonic acid, pentasodium salt (in DEQUEST 2006, available from Monsanto Chemical Co.), and anti-rust agent C was 1-hydroxyethyline-1-diphosphonic acid (in DEQUEST 2010, available from Monsanto Chemical Co.).

Simulated wash baths were formulated by adding each bleaching solution (5 ml) to tap water (995 ml) to simulate the amount of bleaching solution commonly carried over from a bleaching tank. The simulated wash bath temperature was controlled at 38° C. during the day. At night, the wash bath temperature was not controlled, so it cooled to room temperature. The following morning the temperature control was resumed. This process was used to simulate worst case conditions under which a commercial processing machine is used in the trade, that is those situations where the wash baths are stagnant.

The data provided in TABLE I below shows the length of time (hours) after initial processing machine operation when rust precipitates were first observed in the simulated wash baths. A simulated wash bath prepared with a bleaching solution like that shown in Example 1, but without the anti-rust agent, exhibited rust formation within two hours of initial operation of the processing machine.

TABLE I

| COMPONENT | 0.001 mol/l | 0.006 mol/l | 0.01 mol/l | 0.06 mol/l |
|---|---|---|---|---|
| Anti-rust B | 4.5 hours | 22.83 hours | 311 hours | * |
| Anti-rust A | 2.1 hours | 22.6 hours | * | * |
| Anti-rust C | 2.0 hours | 23.5 hours | * | * |
| dipicolinic acid | 1.85 hours | 1.82 hours | 1.78 hours | 5.2 hours |

TABLE I-continued

| COMPONENT | 0.001 mol/l | 0.006 mol/l | 0.01 mol/l | 0.06 mol/l |
|---|---|---|---|---|
| succinic acid | 0.75 hours | 0.72 hours | 1.26 hours | 1.23 hours |
| # | 1.97 hours | 22.4 hours | 142 hours | ** |
| "MES" | 1.87 hours | 1.1 hours | 1.07 hours | 1.033 hours |
| ## | 2.75 hours | 2.75 hours | 4.58 hours | 49.1 hours |
| picolinic acid | 4.5 hours | 4.5 hours | 4.5 hours | 22.83 hours |
| tiron*** | 3.5 hours | 5.08 hours | 5.08 hours | 166 hours |
| glycolic acid | 2.42 hours | 2.42 hours | 2.42 hours | 18 hours |
| maleic acid | 16.8 hours | 16.8 hours | 16.8 hours | 16.8 hours |
| sulfosuccinic acid | 5.3 hours | 5.8 hours | 22.8 hours | 28.9 hours |
| glyoxylic acid | 3.2 hours | 5.3 hours | 5.3 hours | 22.8 hours |
| citric acid | 3.75 hours | 187 hours | * | * |

* No rust observed after 408 hours.
** Precipitation in bleach solution.
*** This is 4,5-dihydroxy-m-benzenedisulfonic acid, disodium salt.
2-Hydroxyl, 3-propylenediaminetetraacetic acid.
Diethylenetriaminepentaacetic acid.
"MES" is 2-(N-morpholino)ethanesulfonic acid buffer.

The results in TABLE I show that effective amounts of the three phosphorus anti-rust agents inhibit rust formation for an extended period of time.

EXAMPLE 3

Processing Method

Samples of KODAK ROYAL GOLD 1000 color negative film were imagewise exposed and processed using conventional Process C-41 solutions and conditions, except that bleaching was carried out using a bleaching solution like that shown in Example 1, except with two different amounts of the anti-rust agent DEQUEST 2000. The effect of bleaching with each solution was evaluated by measuring retained silver ($mg/m^2$)

FIG. 1 shows the results of bleaching effectiveness with the two solutions:

Curve A (0.01 mol/l) and Curve B (0.02 mol/l).

The retained silver at Dmax was measured in each photographic film sample using conventional procedures. Clearly, bleaching was achieved within 4 minutes for both bleaching solutions of this invention.

The invention has been described in detail with particular reference to preferred embodiments thereof, but it will be understood that variations and modifications can be effected within the spirit and scope of the invention.

What is claimed is:

1. A photographic bleaching solution comprising:

a) as a bleaching agent, a ferric ion complex of methylilminodiacetic acid or ethyliminodiacetic acid or salt thereof, wherein ferric ion is present in an amount of from about 0.005 to about 0.5 mol/l and the molar ratio of ferric ion to said methyliminodiacetic acid or ethyliminodiacetic acid or salt thereof is from about 1:1 to about 5:1, and b) from about 0.01 to about 0.1 mol/l of an anti-rust agent that is aminotrimethylene phosphonic acid, 1-hydroxyethylidene-1-diphosphonic acid, or an alkali metal salt of one of these.

2. The bleaching solution of claim 1 wherein said bleaching agent is a ferric ion complex of methyliminodiacetic acid.

3. The bleaching solution of claim 1 wherein said anti-rust agent is aminotrimethylene phosphonic acid or an alkali metal salt thereof.

4. The bleaching solution of claim 1 further comprising a silver ion solvent.

5. The bleaching solution of claim 1 having a pH of from about 2 to about 5.

6. The bleaching solution of claim 5 having a pH of from about 2.5 to about 4.5.

7. The bleaching solution of claim 1 wherein said bleaching agent is a potassium salt of said ferric ion complex.

8. The bleaching solution of claim 1 further comprising a rehalogenating agent.

9. The bleaching solution of claim 1 further comprising a water-soluble aliphatic carboxylic acid buffer.

10. A method of processing a color silver halide photographic element comprising:

bleaching an imagewise exposed and developed color silver halide photographic element with a photographic bleaching solution comprising:

a) as a bleaching agent, a ferric ion complex of methyliminodiacetic acid or ethyliminodiacetic acid or salt thereof, wherein ferric ion is present in an amount of from about 0.005 to about 0.5 mol/l and the molar ratio of ferric ion to said methyliminodiacetic acid or ethyliminodiacetic acid or salt thereof is from about 1:1 to about 5:1, and b) from about 0.01 to about 0.1 mol/l of an anti-rust agent that is aminotrimethylene phosphonic acid, 1-hydroxyethylidene-1-diphosphonic acid, or an alkali metal salt of one of these.

11. The method of claim 10 wherein said photographic element is a color negative photographic film.

12. The method of claim 10 wherein said bleaching is carried out within less than about 4 minutes at a temperature of from about 20 to about 40° C.

13. The method of claim 10 wherein said bleaching solution is replenished at a rate of less than about 1000 $ml/m^2$ element processed.

14. The method of claim 10 wherein said anti-rust agent is aminotrimethylene phosphonic acid or an alkali metal salt thereof.

15. The method of claim 10 wherein said bleaching is immediately followed by a washing step wherein the wash rate is from about 5,000 to about 30,000 $ml/m^2$.

* * * * *